United States Patent [19]

Wise

[11] 4,081,936

[45] Apr. 4, 1978

[54] STRUCTURAL FRAMEWORK WITH IMPROVED CONNECTOR

[75] Inventor: Mark J. Wise, Brookville, Ohio

[73] Assignee: The Flexicore Co., Inc., Dayton, Ohio

[21] Appl. No.: 744,690

[22] Filed: Nov. 24, 1976

[51] Int. Cl.[2] ..... E04H 12/00

[52] U.S. Cl. ..... 52/301; 52/236.7; 52/726; 403/293

[58] Field of Search ..... 52/721, 726, 723, 637, 52/251, 236.7, 301, 126, 585, 263; 403/24, 292; 61/56

[56] References Cited

U.S. PATENT DOCUMENTS

| | | | |
|---|---|---|---|
| 2,305,563 | 12/1942 | Vecker et al. | 52/637 X |
| 3,352,120 | 11/1967 | Pelzer | 52/726 X |
| 3,429,092 | 2/1969 | Perry et al. | 52/236.7 X |
| 3,564,786 | 2/1971 | Baker | 52/637 X |
| 3,594,971 | 7/1971 | Hughes | 52/585 X |
| 3,782,061 | 1/1974 | Minutol et al. | 52/585 X |

*Primary Examiner*—Ernest R. Purser
*Assistant Examiner*—Carl D. Friedman
*Attorney, Agent, or Firm*—Biebel, French & Nauman

[57] ABSTRACT

In a structural framework which includes precast, concrete columns an improved connector is provided for transferring the load of superimposed columns to those beneath them. The connector consists of a spindle which is received in hollow cores of the columns and a sleeve within and to which the spindle is positioned and connected in any convenient manner, such as by a press fit, plug or spot welds. The sleeve transfers the vertical load from one column to another and incremental washers may be utilized intermediate an upper end of the sleeve and a lower end of a column to adjust the vertical elevation of an upper column.

6 Claims, 3 Drawing Figures

STRUCTURAL FRAMEWORK WITH IMPROVED CONNECTOR

BACKGROUND OF THE INVENTION

Structural frameworks employing precast structural components are now used extensively in the construction industry. One system that has gained considerable commercial acceptance is described in U.S. Pat. No. 3,429,092 dated Feb. 25, 1969.

In this system steel pipes are cast in the columns to form hollow cores. Superimposed columns are then joined in load transmitting relationship to each other by means of a threaded spindle having oversized nuts threaded thereon, with the ends of the spindle being received in the hollow cores of the columns and the nuts bearing against the exposed ends of the pipes cast in the columns to transmit load from an upper column to a lower column.

Aside from the fact that this provides an indirect stress transfer path, that is, from a column end to a nut, from the nut to the spindle, from the spindle to the lower nut and thence to the lower column, it will be apparent that providing interfitting threaded components, which are used in substantial numbers in a building system of this type, increases the overall cost of construction.

Additionally, although the columns are cast to rigid dimensional specifications, generally the pipes cast into the columns are of an inexpensive grade and inside pipe diameters may vary considerably. Thus, difficulties have been encountered in inserting the threaded spindles into the column cores and while the threaded spindles can be turned down to reduce their external diameter this may require rethreading and the use of different sized nuts, again increasing the cost of construction.

Despite this, it has been felt that a threaded connector was necessary due to the fact that it is desirable to set the columns at fairly precise elevations.

SUMMARY OF THE INVENTION

The present invention provides an improved connector for precast, hollow core columns of greatly simplified construction which avoids the above noted problems with prior art connectors of this type and yet serves effectively to transmit vertical loads from superimposed columns to those positioned beneath them.

In one form the connector of the present invention comprises a spindle, which need have no appreciable vertical load bearing capabilities and can comprise an inexpensive section of pipe or tubing, together with a load bearing sleeve which encircles the spindle and is preferably permanently attached thereto by any convenient means.

With this construction the ends of the spindle are inserted in the upper and lower ends of the hollow core columns with an upper end of the sleeve bearing against the upper end of the lower column and a lower end of the sleeve bearing against the upper end of the lower column.

To provide for vertical adjustment of the upper columns a series of washers may be utilized that can be simply placed over the upper end of the spindle. The washers may be formed in varying thicknesses depending upon the degree of accuracy required for setting the elevation of the column with, for example, the washers being manufactured in multiples of $\frac{1}{8}$ inch thickness, thereby permitting adjustments to within one-eight inch, well within normal tolerances.

Additionally, the washers can be of split construction to permit their being positioned about the spindle after the upper end of the spindle has been received in the lower end of an upper column.

The connection between the sleeve and the spindle can be a simple press fit or formed by one or two plugs or spot welds, since there is no transfer of stress from the sleeve to the spindle and the sleeve bears the entire vertical load.

In one preferred embodiment of the invention the pipes cast in the columns have their exposed end portions either flush with or projecting slightly from the ends of the columns.

In another embodiment of the invention, in place of the integral load bearing sleeve, a pair of fixed collars may be welded directly to the outer surface of a smooth spindle, thus avoiding the problems and expense of the threaded construction of the prior art. As in the other embodiment, adjustments in elevation may be accomplished by suitable washers.

Thus, the present invention provides an improved connector of simplified construction which nonetheless permits elevational adjustment of support columns within normal tolerances.

DESCRIPTION OF THE PREFERRED EMBODIMENTS

Figure 1:
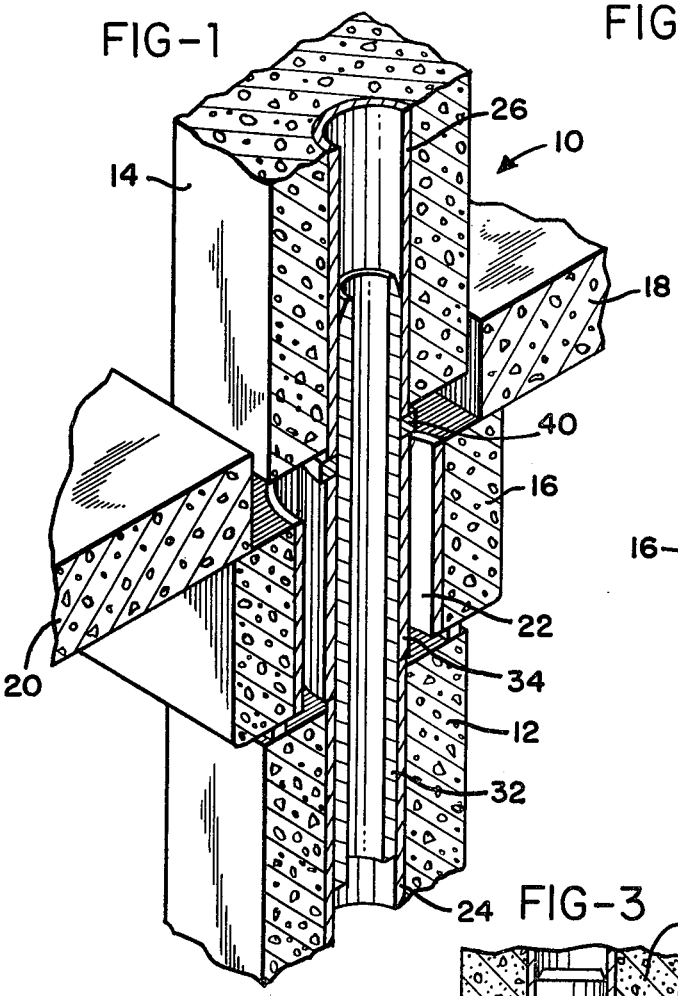
FIG. 1 is a partial perspective view of a typical precast structure incorporating the connector of the present invention.

FIG. 1 of the drawings shows a precast, concrete construction 10, which includes a lower column 12, an upper column 14, an intersecting beam 16 and floor slabs 18 and 20. The beam 16 is provided with a vertically extending opening 22 so that a connector can extend through the beam to join the lower and upper columns 12 and 14.

Figure 2:
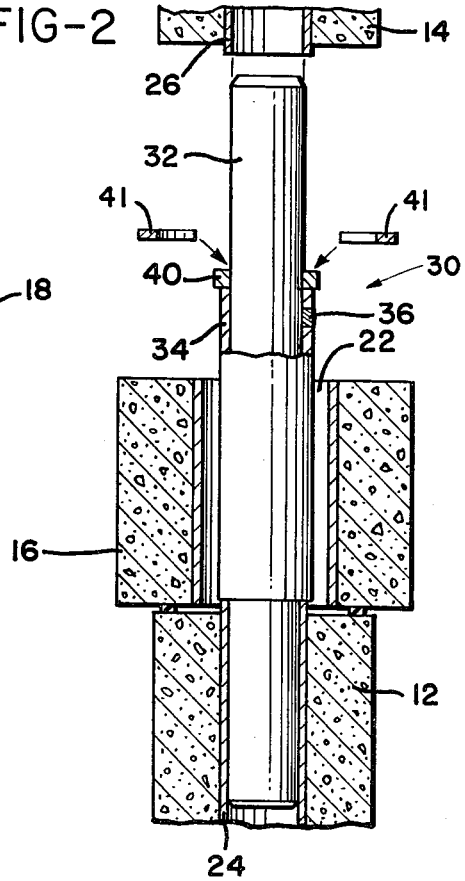
FIG. 2 is an elevational view, partly in section, of the connector shown in FIG. 1.

As shown in FIGS. 1 and 2, each of the columns has embedded therein a hollow pipe, as at 24 and 26. In accordance with this embodiment of the invention the pipes 24 and 26 may have their ends substantially flush with the ends of the columns or they can protrude somewhat therefrom as shown.

A connector 30 includes a spindle 32, which may be a piece of inexpensive tubing or pipe since it need have no appreciable vertical load carrying ability, although spindle 32 will be of sufficient strength to assist in aligning the columns to hold the upper column erect temporarily. Attached to the spindle 32 is a sleeve 34 which is preferably fixed thereto by any convenient means.

The sleeve 34 may be press fitted on spindle 32. Alternately plug or spot welds can be used as shown at 36 in FIG. 2 of the drawings. The particular manner of attaching the spindle within the sleeve is not significant since the attachment serves only to hold the two members together and does not provide any load bearing capability.

Where elevational adjustment of the upper column is desired, washers, which may be of one piece or split construction, as shown at 40 and 41, respectively, can be slipped over the upper end of the spindle 32 as necessary. One piece washers are used when measurements are taken before erecting the upper columns. Split washers are used after upper columns have been placed. The split washers are inserted by raising the upper columns slightly while installation of one piece washers would require removal of the upper columns.

With the above construction it will be seen that the load of the upper column 14 is transferred directly through the sleeve 34 to the lower column 12, avoiding the more indirect stress transfer route of the prior art and providing a much simplified construction.

Figure 3:
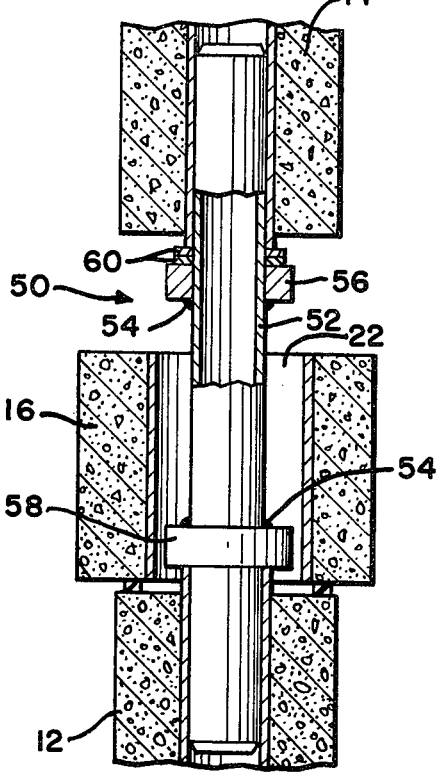
FIG. 3 is a view similar to FIG. 2 but showing a second preferred embodiment of the invention.

A second embodiment is shown in FIG. 3 wherein the connector 50 includes a spindle 52 to which is attached by welding 54 spaced upper and lower collars 56 and 58. While the load from the upper column to the lower column is somewhat more circuitous than with the previous embodiments, nonetheless a greatly simplified construction in comparison to prior art connectors of this type is provided, with elevation variations being accompanied by washers 60, which may be of split or one piece construction, encircling the spindle above the upper collar 56.

From the above it will be seen that two embodiments of connector are provided in accordance with the present invention which are of inexpensive construction and yet serve efficiently to connect vertically superimposed, precast hollow core columns.

While the forms of apparatus herein described constitute preferred embodiments of the invention, it is to be understood that the invention is not limited to these precise forms of apparatus, and that changes may be made therein without departing from the scope of the invention.

What is claimed is:

1. In a structural framework including a lower column having a hollow core, an upper column having a hollow core and superimposed above said lower column and an intersecting beam having a vertically extending opening therethrough intermediate said upper and lower columns, a unitized, load-transmitting connector comprising:

a spindle extending through said beam opening and received within said hollow cores of said columns, said spindle being in substantially non-vertical load bearing relationship to said upper column, an integral sleeve surrounding said spindle and at least partially received in said beam opening, said sleeve being in load bearing relationship to said upper column, transferring said weight of said upper column to said lower column by bearing contact therewith, and means fixing said sleeve to said spindle with insufficient strength to carry said weight of said upper column.

2. The framework of claim 1 further comprising:

washer means encircling said spindle between an upper end of said sleeve and a lower end of said upper column.

3. The framework of claim 2 wherein:

said washer means comprises split washer means.

4. The framework of claim 1 wherein:

said hollow cores of said columns include pipes cast in said columns, and upper and lower ends of said sleeve contact ends of said pipes.

5. The framework of claim 1 wherein:

said sleeve fixing means comprises welds between said spindle and said sleeve.

6. In a structural framework including a lower column having cast therein a hollow pipe exposed at an upper end of said column and an upper column having cast therein a hollow pipe exposed at a lower end of said column and superimposed on said lower column, a unitized, load-transmitting connector for transferring the weight of said upper column to said lower column comprising:

a hollow spindle having an outer diameter less than the inner diameters of said column pipes, a sleeve having an outer diameter greater than the inner diameters of said column pipes and an inner diameter greater than the outer diameter of said hollow spindle, means fixing said spindle within said sleeve with upper and lower ends of said spindle projecting from upper and lower ends of said sleeve, said fixing means being insufficient to withstand shear forces generated by the weight of said upper column, said spindle having said upper and lower ends thereof received within said column's pipes and being substantially free of vertical shear forces, a washer encircling said spindle intermediate said lower end of said upper column and said upper end of said sleeve, and said washer and said sleeve transmitting the load of said upper column to said lower column.

* * * * *